United States Patent [19]

Guy

[11] 4,035,051

[45] July 12, 1977

[54] ADJUSTABLE MOLDED HOOD ASSEMBLY FOR A CABLE CONNECTOR PLUG

[75] Inventor: Rodney J. Guy, Boulder, Colo.

[73] Assignee: Western Electric Company, Inc., New York, N.Y.

[21] Appl. No.: 733,837

[22] Filed: Oct. 19, 1976

[51] Int. Cl.[2] ..... H01R 13/58

[52] U.S. Cl. ..... 339/103 R; 174/138 F; 339/36; 339/75 M; 339/107

[58] Field of Search ..... 339/103 R, 103 C, 103 M, 339/103 B, 107, 36, 105, 49 R, 39, 104, 106, 75 M, 99 R; 174/138 F

[56] References Cited

U.S. PATENT DOCUMENTS

| | | | |
|---|---|---|---|
| 3,794,960 | 2/1974 | Sugar | 339/107 |
| 3,803,530 | 4/1974 | Lapraik | 339/36 |
| 3,936,129 | 2/1976 | Guy | 339/36 X |

*Primary Examiner*—Roy Lake
*Assistant Examiner*—DeWalden W. Jones
*Attorney, Agent, or Firm*—K. R. Bergum; R. P. Miller

[57] ABSTRACT

Two protective molded plastic hood embodiments are disclosed that are particularly adapted for use in securing multi-conductor cables to connector plugs of the type typically having one or more arrays of terminals of either the soldered or solderless type associated therewith. Each plastic hood, by having a pressure pad integrally connected to a pressure pad-receiving hood extension formed as an integral rearward portion of the main body of the hood, advantageously allows the composite hood not only to be of one-piece construction, but allows the pressure pad to be key-way guided in a telescopic manner into the hood extension. This insures that reliable, diametrically opposed clamping forces, provided by a cable tie, will always be imparted against a section of cable when positioned between the pad and hood extension, regardless of the diameter of the cable (or cables). In addition, cooperative cable engaging ribs of the pressure pad and hood significantly augment cable strain-relief otherwise effected by only the cable tie-initiated clamping force.

As also realized in accordance with one preferred embodiment, the pressure pad, as distinguished from the hood extension, is adapted to nest the head of the cable tie therewithin, such that the height of the hood extension may be at the same elevation as the main body portion of the hood and, thereby, minimize the height of the composite assembly. Finally, with both of the disclosed hood embodiments being of one-piece molded plastic construction, and being adapted to effect a sliding snap-on type of locked securement with an associated connector plug, no auxiliary fastening members are required.

21 Claims, 16 Drawing Figures

FIG. 1
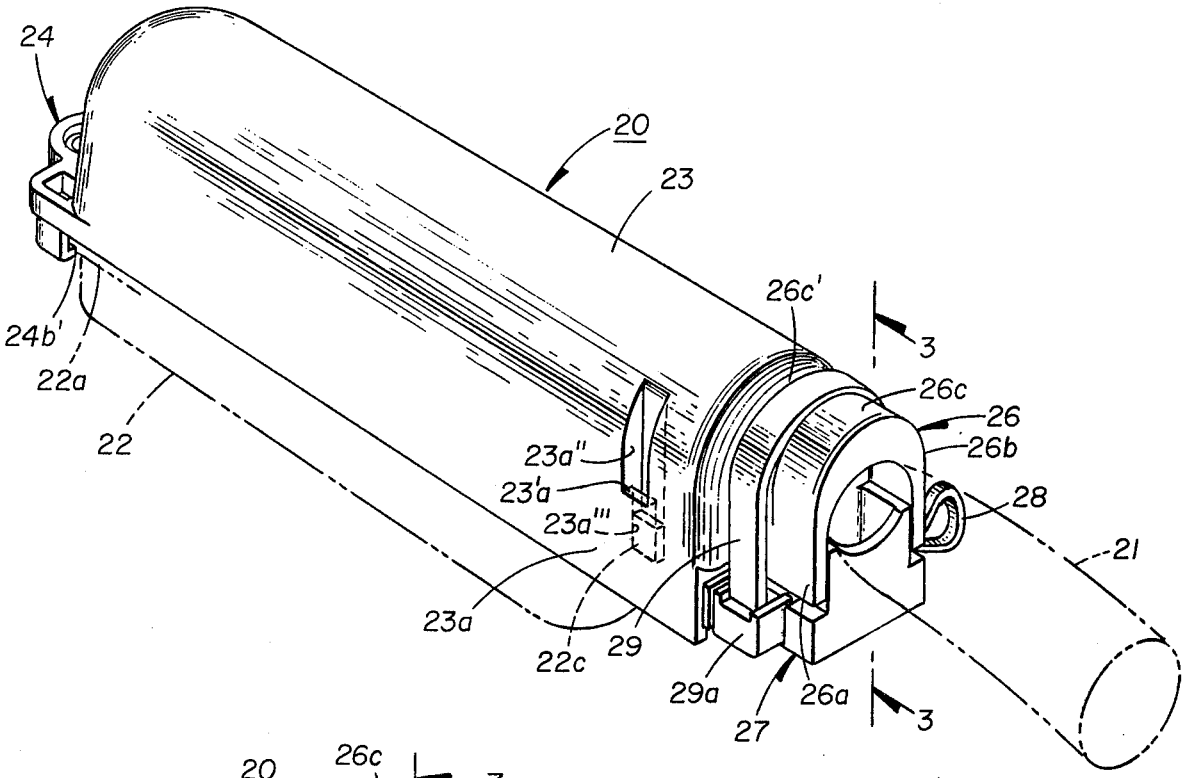
FIG. 2
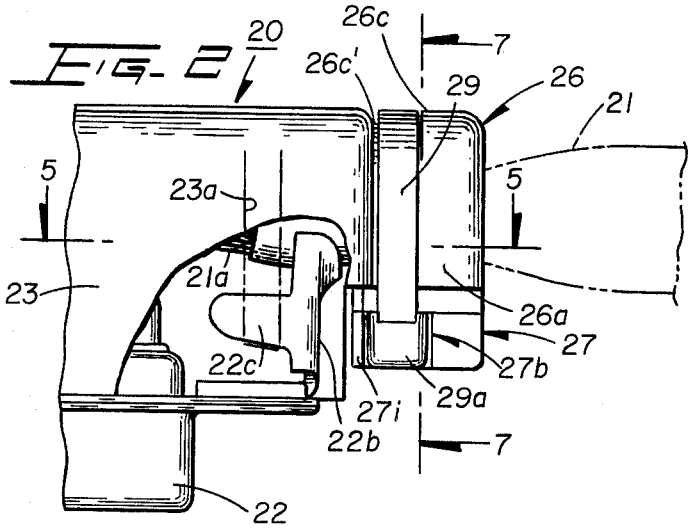
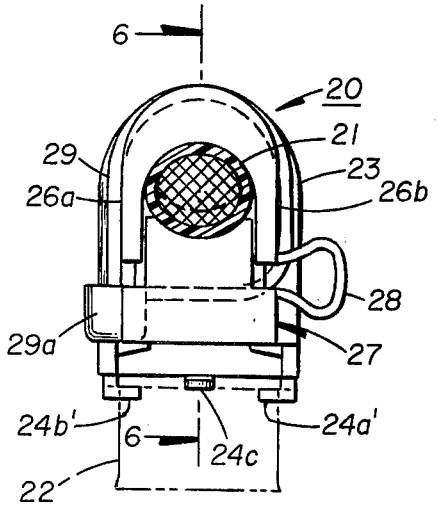
FIG. 3
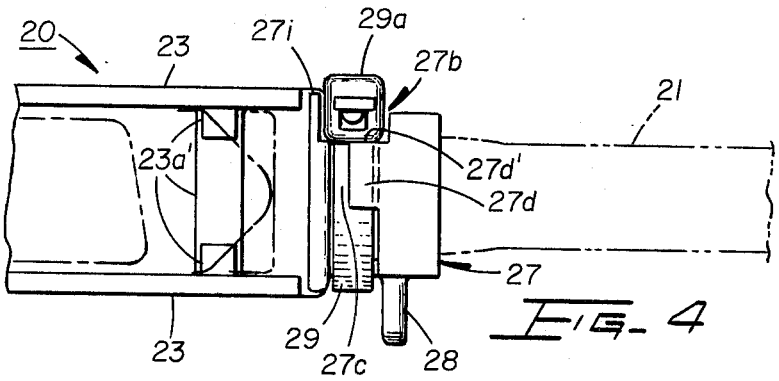
FIG. 4

FIG. 5
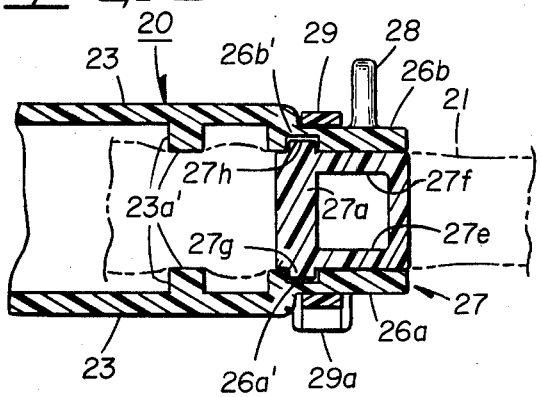
FIG. 6
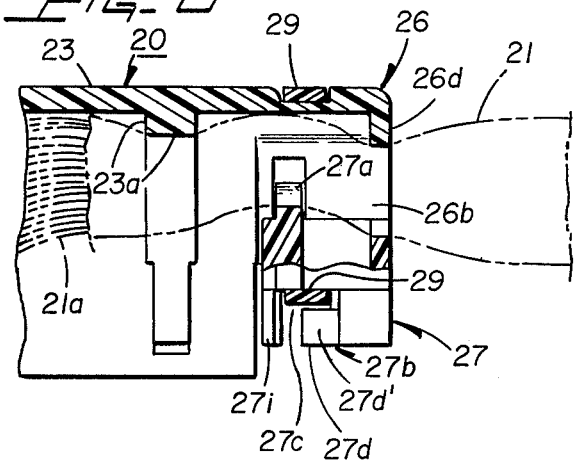
FIG. 7
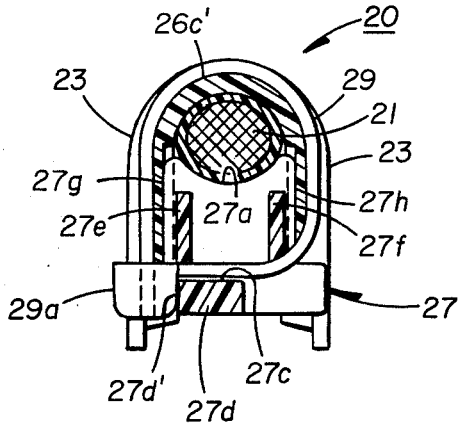
FIG. 8
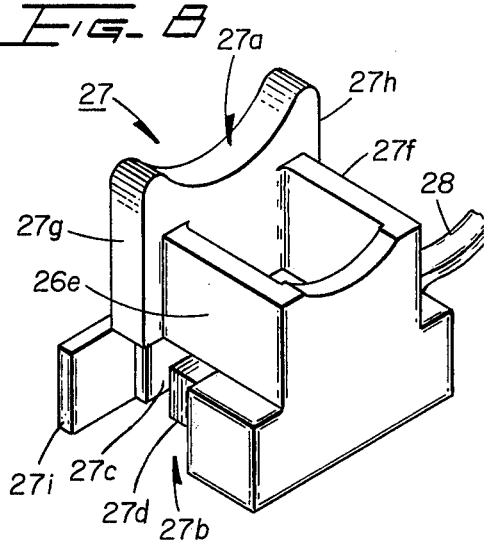
FIG. 9
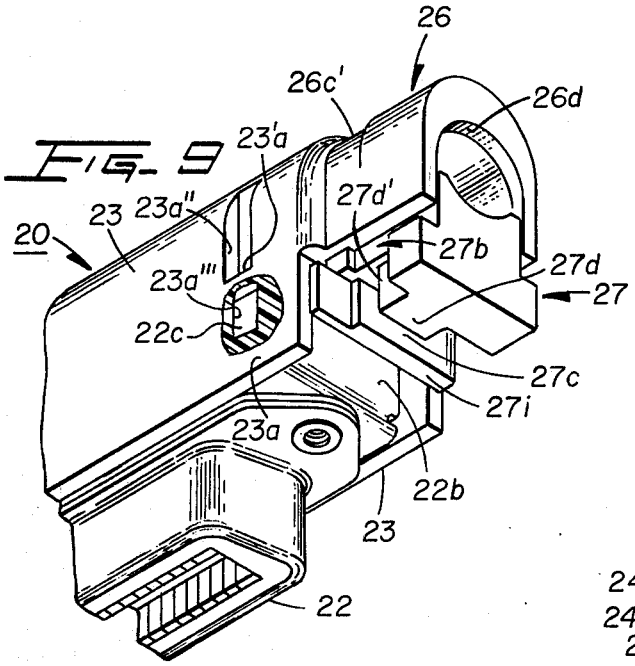
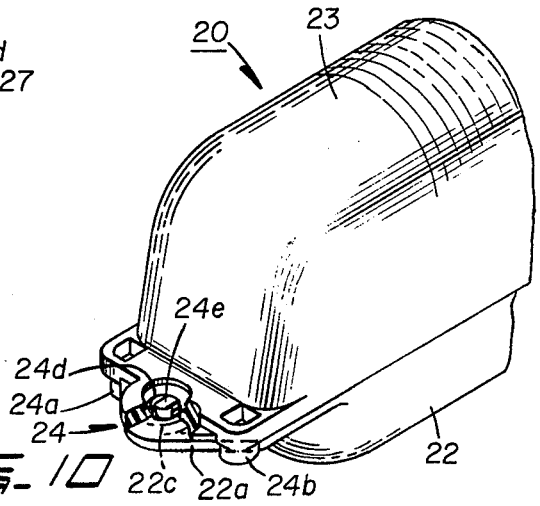
FIG. 10

ADJUSTABLE MOLDED HOOD ASSEMBLY FOR A CABLE CONNECTOR PLUG

BACKGROUND OF THE INVENTION

1. Field of the Invention

This invention relates to protective housings for cable connector plugs and the like and, more particularly, to a molded plastic hood therefor of simplified, rugged and inexpensive construction, and to a hood-connector plug assembly adapted for use with cables of varying diameter.

2. Description of the Prior Art

In the communications industry, in particular, multi-conductor, jacketed cable is extensively used, such as in telephone office switching equipment, PBX's and computers. To effect electrical connections between the terminating ends of such multi-conductor cables (typically of the 25 or 50 twisted wire pair type) to associated electrical equipment, connector plugs having an array of terminals of either the soldered or solderless type are employed.

In order to provide protection for the connections formed between the bare ends of the conductors and the respectively associated terminals of the connector plug, a protective hood is secured to the frame of the connector plug such that the completed connections are shielded from the outside. The hood is also formed to allow the outer jacket of the cable to be firmly secured thereto so that no adverse tensile forces can be imparted to any of the terminal-secured conductor ends confined within the housing during subsequent handling or use.

Such protective hoods have often been formed out of metal heretofore, with suitable fastening members, such as screws, being employed to secure the hood to the connector plug at either or both common ends thereof. In one embodiment of such a hood, eyelets formed in the hood adjacent the rearward end thereof, and ears formed in the rearward end of the connector plug, cooperate to effect securement. Such hoods have also typically included a rearward hood extension that is positioned to overly a section of the cable jacket, and been formed with downwardly extending and spaced clamping lugs adapted to straddle the jacket. The cable is secured to the hood by another metal screw which is inserted through apertures in these lugs adjacent their lower ends and tightened to clamp the lugs about the cable jacket. Since the position of the lugs and the locations of the screw apertures therein are fixed, it has been necessary heretofore to provide multiple or different sized inserts for use between the cable jacket and the clamping screw in order to accommodate cables of different diameter. As a result of their construction, metal protective hoods are not only more expensive than molded plastic hoods, but they have also required a number of loose parts that must be assembled. Moreover, a metal hood obviously cannot function as an insulative member to prevent the shorting out of any bare conductor ends that for some reason might become dislodged from the associated terminal of the connector plug after the assembly thereof.

A molded plastic hood intended to overcome some of the disadvantages of a metal hood assembly is disclosed in Scott J. Lapraik U.S. Pat. No. 3,803,530. That hood includes overlapped forward and rearward U-shaped body shells secured to a connector plug by means of a threaded screw at each end. An upper, rearward hood extension of the outer shell is adapted in one embodiment of the cited patent to receive a separate channel-guided clamp, secured to a lower hood extension by a fastening screw. Clamping forces between the hood extension and the clamp is established by advancing inwardly the fastening screw. This type of hood, as in the case with the previously described metal hood, also requires a number of different loose parts that must be assembled in order to form a composite hood, as well as a composite hood-plug-cable assembly.

In another hood embodiment disclosed in the last cited patent, the adjustable screw-actuated clamp is replaced by a conventional cable tie that surrounds a section of the cable jacket and hood extension. As there is no means provided in this latter hood against which the head of a cable tie can abut, the tie has a tendency to shift circumferentially as it is being drawn tightly around the cable jacket and hood extension.

In addition, as most cable ties have a relatively smooth inner major surface, or at most very minute serations, such surfaces cannot be relied upon to effectively grip the cable jacket in contact therewith. Thus, while the hood extension normally is formed with cable engaging ribs, they generally cannot be relied upon alone to provide effective strain-relief (i.e., the prevention of axial, as well as rotational displacement) for the cable during both assembly and normal use.

With respect to strain-relief per se, a commercially available molded plastic device sold by the Heyman Mfg., Co., under the tradename "Heyco", includes a molded body portion adapted to telescopically receive a portion of a pressure pad which includes a strain-relief rib, with the pad being interconnected to the body portion by a molded flexible strap or tongue. While such a strain-relief rib when formed with a semi-circular inner surface does provide substantial cable gripping action, it is not as effective and reliable as in the case where a plurality of spaced ribs would establish a circuitous cable route that would, in turn, result in a pronounced undulation in the cable. Further, the above described strain-relief device is only adapted to be resiliently force-fit within an aperture of an associated housing, there are no structural provisions to effect the desired strain-relief induced clamping force by separate means, such as with a cable tie, or an adjustable biasing member.

R. J. Guy, U.S. Pat. No. 3,936,129, assigned to the same assignee as the present invention, discloses a molded plastic hood having a composite hood extension and an integral pressure pad that cooperates with a cable tie to firmly secure a cable to the hood. The hood extension of the latter hood, however, has no provision to telescopically receive and/or otherwise key-way guide the pad therewithin so as to insure that consistently reliable clamping forces will be exerted against the outer jacket of the cable from diametrically disposed sides thereof, as is desired in order to establish the most effective type of gripping action and strain-relief. While the last mentioned hood does provide a raised boss with an eyelet therethrough that facilitates the positioning and biasing of the tie head against the boss, there is no provision that allows the head of the tie to be substantially nested in the upper portion of the hood extension so as to provide a relatively smooth, unobstructed, outer surface hood profile. Moreover, the raised boss in question must necessarily protrude upwardly from the upper surface of the main body of the hood, which unfortunately increases the overall height of the composite hood. As such, it would be particularly desirous if the integral pressure pad, rather than the raised boss in the hood extension, were formed with a recess to receive the cable tie head. This would advantageously allow the overall height of the composite hood-plug-cable assembly to be minimized.

In still another type of plastic molded hood assembly commercially available, a U-shaped clamp is adapted to simply snap-on to a receiving rearward hood extension of the hood so as to secure the cable to the connector plug. In addition to such an arrangement requiring two separate hood related parts, the snap-on clamp is not adapted to accommodate and reliably clamp cables of even closely related, but different diameters, not to mention being adapted for use with juxtaposed cables, as is sometimes desired when a given connector plug has a sufficient number of terminals to accommodate the conductors of two cables.

SUMMARY OF THE INVENTION

It, therefore, is an object of the present invention to provide a simplified and rugged molded plastic hood assembly particularly adapted for cable connector plugs, that requires a minimum of loose parts, is adjustable for use with cables of varying diameter, as well as for use with two juxtaposed cables, and allows a rearward cable clamping hood extension to be at the same height as the main body of the hood, with the hood extension simultaneously cooperating with a key-way guided and integral pressure pad to establish reliable, symmetrically disposed cable clamping forces, as well as effective cable strain-relief, by means of a firmly seated cable tie.

In accordance with the principles of the present invention, the above and other objects are realized in one preferred embodiment wherein a one-piece molded plastic hood assembly, particularly adapted for use with connector plugs of either the soldered or solderless types (e.g., of the 25 or 50 terminal type) includes, in addition to a forward end portion that snaps into locked relationship with an associated end portion of a connector plug during the assembly thereof, a rearward U-shaped hood extension and an integral pressure pad, interconnected by a flexible, arcuate strap or tongue. The hood extension is advantageously adapted to telescopically receive and key-way guide the pad, incorporating a cable-engaging strain-relief rib, therewith so as to allow cables of different diameters to be reliably clamped, from diametrically disposed sides, therebetween by means of an encircling cable tie. The telescopically receivable pressure pad advantageously also allows cables of substantially different diameter, as well as two juxtaposed cables, to be firmly secured to the hood.

By also providing a recessed area in the bottom surface of the pressure pad, rather than in a raised boss in the upper surface of the hood extension, as is an alternative embodiment, to accommodate the head of the tie, the upper surface of the hood extension can advantageously merge into the main body portion of the hood at the same elevation which, as previously mentioned, has the salutary effect of minimizing the total height of the composite connector plug assembly. In this latter embodiment, a slot is also formed in the pressure pad, and communicates with the recess formed therein, so as to facilitate the positioning and tightening of the cable tie about the composite hood extension, pressure pad and jacketed section of a cable positioned therebetween.

In accordance with a second embodiment of the hood, a raised boss formed in the upper surface of the hood extension includes both a recess to receive at least a portion of of the cable tie head, and a tie-receiving eyelet to facilitate the positioning and tightening of the cable tie about the composite hood extension, pressure pad and cable positioned therebetween, as in the previously described embodiment.

BRIEF DESCRIPTION OF THE DRAWINGS

FIG. 1 is a perspective view of one preferred protective hood embodying the principles of the present invention, as assembled with a cable tie to a cable connector plug and associated cable;

FIG. 2 is an enlarged, fragmentary, side elevational view, partially broken away, of the rearward end portion of the hood, with associated adjacent portions of a connector plug and a cable being shown secured thereto with a cable tie;

FIG. 3 is an end view of the hood and cable, with the connector shown only in phantom, as viewed in the direction of the arrows 3—3 in FIG. 1;

FIG. 4 is an enlarged, fragmentary, bottom view of the assembled hood of FIG. 1;

FIG. 5 is an enlarged, fragmentary, detail sectional view taken along the line 5—5 of FIG. 2, showing in greater detail the cross-sectional configuration of the pressure pad, and the manner in which the latter is key-way guided telescopically within the receiving U-shaped hood extension of the hood of FIG. 1;

FIG. 6 is an enlarged, fragmentary, sectional view, taken along the line 6—6 of FIG. 3, showing the position of, and the strain-relief function performed by, the cooperative cable engaging ribs respectively formed in the hood extension and mutually disposed pressure pad;

FIG. 7 is a cross-sectional view taken along the line 7—7 of FIG. 2 in the region of the hood extension, and shows in particular the manner in which the head of a cable tie is firmly confined within the recess of the pressure pad, and how it extends through a slot formed therein prior to enveloping the hood extension, and thereafter being threaded through the head of the tie in a completely assembled condition;

FIG. 8 is a perspective view of the telescopically insertable and integral pressure pad of the hood embodiment of FIG. 1;

FIG. 9 is an enlarged, fragmentary, perspective view, showing details of the hood of FIG. 1 from the underside thereof, as secured to a connector plug;

FIG. 10 is a fragmentary, perspective view of the forward end portion of the hood, illustrating the manner in which it is resiliently locked to the mating forward end portion of an associated connector plug;

DETAILED DESCRIPTION

Figure 11:
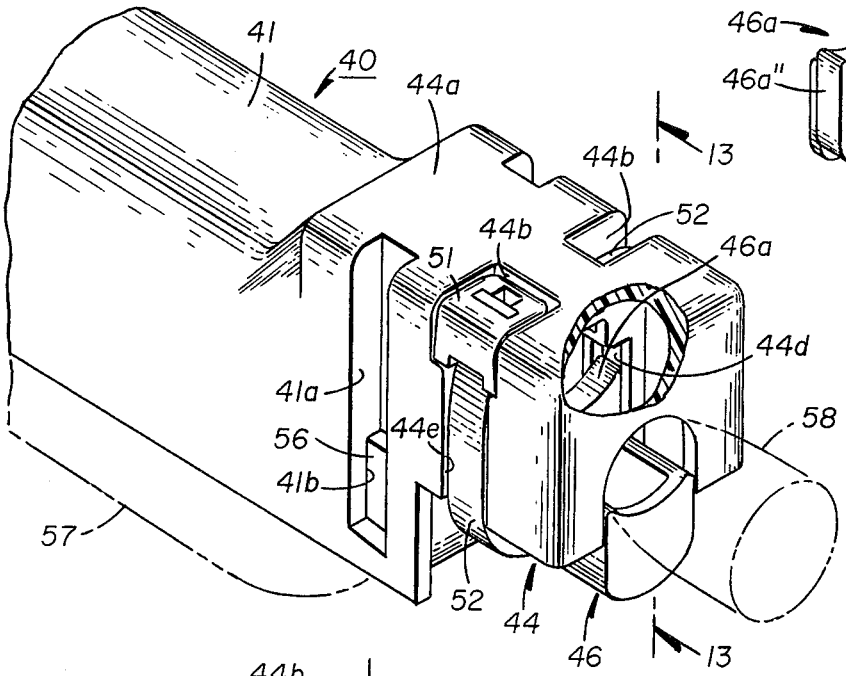
FIG. 11 is a fragmentary perspective view, partially broken away, of an alternative hood embodiment in accordance with the principles of the present invention.

It should be appreciated that the protective hoods as embodied herein, and as described in greater detail hereinbelow, have universal application in providing electrical shielding for the terminating and connector-secured ends of multi-conductor cables. To that end, and by way of more specific illustration, the two preferred hood embodiments of the present invention are disclosed for use with cable connector plugs of the type having a plurality of either male or female conductor-receiving terminals of either the soldered or solderless type.

With particular reference first to FIG. 1, an elongated protective hood 20, molded as one piece out of plastic is secured to both a multi-conductor cable 21 and an elongated cable connector plug 22, with the latter having a plurality of terminals (not shown) that are respectively connected to the terminating ends of a corresponding number of cable conductors 21a (see FIG. 2) in a well known manner. By way of example, the conductor plug 22 typically has either 25 or 50 male or female type terminals, spaced apart in one or more linear arrays, with the terminating ends of the conductors being fanned out within the cavity-defining enclosure of the hood 20 so as to allow permanent terminal-conductor securement by either soldered or solderless assembly techniques.

The hood 20 is comprised of a main body 23, a forward end portion 24 that preferably snaps into locked relationship with an associated forward end portion of the connector plug 22 during the assembly thereof, a rearward hood extension 26, and an integral pressure pad 27 (best seen in FIG. 8) that is interconnected with the hood extension by a narrow, resilient and arcuate strap or tongue 28. The hood 20 is preferably molded out of a fire resistant plastic having only a minimal degree of resiliency. Such characteristics are realized when the hood is molded out of a plastic such as sold under the tradename "Noryl" (990) by the General Electric Company, Selkirk, N.Y. Another plastic that is suitable for the intended purpose is acrylonitrile-butadiene-styrene (ABS), sold by any one of a number of companies active in the plastics field, one being Borg Warner.

Considering the construction of the composite hood 20 now in greater detail, the rearward hood extension 26 thereof, in accordance with the principles of the present invention, is formed into a substantially U-shaped configuration with parallel extending sidewalls 26*a*, *b* that merge into an upper, semi-circular wall portion 26*c*. The hood extension is dimensioned such that the upper arcuate and parallel extending inner wall surfaces thereof initially substantially freely accommodate a section of cable 21 of predetermined diameter therewithin.

As previously mentioned, the pressure pad 27, best seen in FIG. 8, is integrally connected to the hood extension 26 by a resilient tongue 28. The latter has a length that allows the pressure pad to be telescopically received within the hood extension to a depth that results in an inwardly extending strain-relief rib 27*a* of the pad firmly engaging the jacketed underside of a section of cable 21 previously inserted within the hood extension. For this purpose, it should be understood that the tongue 28 could just as readily be connected at one end of the main body 23 of the hood, if desired, for any particular application.

In order to augment the strain-relief effect produced by the pressure pad-engaging rib 27*a*, the inner surface of the arcuate wall portion 26*c* of the hood extension 26 is formed with an inwardly extending rib 26*d* adjacent the rearward cable-receiving entrance thereof, as best seen in FIGS. 6 and 9. The upper arcuate surface of the main hood body 23 is also formed with an inwardly extending arcuate rib 23*a* (see FIG. 6), which merges into two parallel extending sidewall ribs 23*a'* (see FIG. 5). The ribs 26*d* and 23*a*, as depicted in FIG. 6, are spaced on either side of the normally positioned pressure pad rib 27*a* so as to establish a pronounced undulation in a terminating end section 21*a* of the cable 21 passing through the hood extension. This sinuous path of travel of the terminating end section of the cable has been found to provide excellent strain-relief, even when a minimal amount of clamping force is imparted against the pressure pad 27. The sidewall ribs 23*a'*, of course, if properly dimensioned for a given size cable, provide further undulations in the cable jacket which facilitates the reliable securement thereof to the hood 20. All of the described ribs also serve another beneficial function, namely, to provide rigidity to the hood even when formed with relatively thin walls.

In accordance with the principles of the present invention as embodied in the hood 20, the pressure pad 27 is formed with a recessed area 27*b* that communicates with one sidewall and the underside thereof (best seen in FIGS. 1, 2, 4, 8 and 9), and accommodates at least a portion of the head 29*a* of a cable tie 29. As best seen in FIG. 7, the pressure pad 27 is also formed with a slot 27*c* defined between an integral boss 27*d* and the lower edges of two mutually disposed sidewalls 27*e*, *f*. This slot is provided to insure the accurate positioning of a section of the cable tie 29 nearest the head thereof. As such, upon the cable tie 29 being drawn through the slot 27*c*, and then wrapped about the outer wall surfaces of the hood extension 26, and then back through an eyelet of the cable tie head 29*a* and locked therein, the head is firmly and reliably biases against the then adjacent sidewall 27*d'* of the boss 27*d*, as best seen in FIGS. 4 and 7.

By also forming a recessed groove 26c' in the upper arcuate surface 26*c* of the hood extension, the cable tie is reliably guided about the hood extension. Equally important, the groove 26*c'* results in the hood extension, with an assembled cable tie, being at approximately the same elevation as the main body 23 of the hood. This has the salutary effect of minimizing the total height of the composite connector plug-hood assembly, and resulting in a very trim and compact connector plug-hood assembly. The height of the composite assembly, of course, often constitutes a critical dimensional parameter in certain applications, such as where the available space in an equipment cabinet, for example, is at a premium.

During the securement of a terminating cable end to the hood, it becomes apparent that when the pressure pad 27 has been telescopically inserted into the mating hood extension 26 to the requisite depth, to firmly engage the underside of the jacketed cable, the integral tongue 28 is bent into a substantially tight U-shaped configuration, as best seen in FIG. 1. If desired after the composite assembly of the cable, hood, pressure pad and cable tie, the outwardly extending portion of the tongue 28 can be readily severed so as to provide a completely unobstructed outer hood profile in the region where the tongue was originally located. This normally is not required in practice, however, as the tongue 28 is relatively narrow, and may readily be dimensioned to be relatively resilient.

In order to consistently insure that the pressure pad 27 is accurately oriented while telescopically inserted within the hood extension 26, the sidewalls 26*a* and *b* of the latter are formed with key-way guiding grooves 26*a'*, 26*b'* (see FIG. 5) that respectively receive a pair of alignment ridges 27*g*, *h*, (see FIGS. 5 and 8) that form part of the cable engaging pressure pad rib 27*a*. As thus key-way guided, the pressure pad is always maintained in the desired orientation, i.e., in a position that cooperates with the hood extension, so as to impart clamping forces against a section of cable therebetween from diametrically disposed sides of the latter. As previously mentioned, such opposed clamping forces are very important in order to effect reliable securement of a cable, regardless of diameter, to the hood under all possible conditions, and particularly during and after the assembly thereof with associated equipment.

As also best seen in FIGS. 2, 8 and 9, the pressure pad 27 further includes a integral forward planar portion 27*i* that is positioned and dimensioned so as to either bias against, or be positioned immediately adjacent to, a rearward end portion 22*b* of the connector plug. This both provides additional shielding of the otherwise partially exposed rearward open end of the connector plug and hood extension, and augments connector plug retention within the hood assembly should the forward snap-on type of hood-plug securement become ineffective for any reason.

With respect to the securement of the connector plug to the hood at the common forward ends thereof, as best seen in FIG. 10, this is preferably accomplished by forming a pair of spaced and downwardly projecting connector plug retainer tabs 24*a*, *b* in the forward planar hood portion 24. Each of the tabs has a horizontal slot 24*a'* (or 24*b'*) formed therein (see FIG. 1) which is adapted to receive an adjacent edge portion of an underlying planar connector plug frame portion 22*a* in sliding relationship therewith. The slotted retainer tabs 24*a*, *b* are thus effective in precluding relative movement of the assembled hood and connector plug in a first horizontal direction perpendicular to their longitudinal axes, and in a second direction perpendicular to the planar hood portion 24.

As also depicted selectively in FIG. 3 and 10, a retainer tab 24*c* (FIG. 3) is molded as part of the forwardly projecting hood portion 24, and is suspended in a cantilever fashion within a partial aperture 24*d* (FIG. 10) by a resilient integral hinge portion 24*e*. A portion of the cantilevered retainer tab 24*c*, by normally projecting downwardly below the bottom planar surface of the hood portion 24, is capable of being initially deflected upwardly as the forward planar connector plug section 22*a* is slid into the slots of the tabs 24*a*, *b*, with the tab 24*c* thereafter snapping into an aligned aperture or opening 22*c* formed in the forward planar plug portion 22*a*. As such, the resilient retainer tab 24*c* is effective in preventing relative movement between the hood 20 and the connector plug 22 in a third direction parallel to their longitudinal axes. For further details of such snap-on locking details, reference is made to the aforementioned Guy patent incorporated herein by reference.

As best seen in FIG. 1, each parallel extending sidewall of the hood 20, near the rearward end of the main body 23 thereof, is formed with a recessed groove 23*a'*. These grooves, in turn, respectively merge into the previously identified sidewall ribs 23*a'* which, in turn, merge into the upper arcuate rib 23*a*. It is this latter rib, as previously mentioned, that cooperates with the pressure pad engaging ribs 26*a* and the hood extension arcuate rib 26*d* to provide an effective strain-relief undulation in the cable, as best seen in FIG. 6.

A pair of aligned slots 23*a'''* are formed near the base of each groove 23*a''*, and are dimensioned to receive a projecting ear 22c (see FIGS. 1 and 9) of the connector plug, as the latter is slid into relationship with the hood during their assembly. Primarily to accommodate a spring-clip (not shown) which may be used to interconnect the composite connector plug-hood assembly to a mating connector block (not shown), the grooves 23*a''* have lower, outer portions thereof partially enclosed by thin-wall extensions of the main hood body sidewalls 23*a*, *b*. Each of the sidewall grooves is thus formed with a recessed or notched area, including an upper laterally disposed shoulder 23'*a* (or 23'*b*) against which a terminating leg portion of a spring clip may be resiliently locked by a snap-on type of action.

In connection with the above-described strain relief ribs, it is appreciated, of course, that any number of additional reinforcing ribs may be readily formed in a spaced array along the inner sidewalls of the hood so as to provide whatever degree of strain relief, as well as structural hood ridigity, is deemed necessary for a particular application.

In accordance with the principles of the present invention, an alternative hood embodiment, designated by the reference numeral 40, is depicted in FIGS. 11–16. The hood 40, as the hood 20, is molded as one piece out of plastic, and comprises a main body portion 41 (only partially seen in FIG. 11), a forward planar snap-on securing end portion (not seen), which is preferably identical to the corresponding forward end portion 24 of the hood 20, a rearward hood extension 44, and an integral pressure pad 46 that is integrally connected to the hood extension by a narrow resilient tongue 48 (seen in FIGS. 13 and 16).

The hood 40 distinguishes over the hood 20 primarily by the manner in which the hood extension 44 is constructed. More specifically, it is formed with a slightly raised and flat upper wall portion 44*a* that preferably has two spaced recessed areas 44*b* formed on either side thereof. These mutually disposed recesses are dimensioned so as to substantially nest the head 51 of the cable tie 52 therewithin. In this manner, either of the recesses 44*b* provides an effective stop against which the inner side of the cable tie head is biased both while and after the cable tie is tightened sufficiently so as to provide the desired clamping force against a cable section previously positioned between the hood extension and the pressure pad. While two recesses 44*b* have been shown so as to facilitate the wrapping of a cable tie selectively in either direction around the composite hood extension, pressure pad and cable, it is obvious that only one recess 44*b* need be formed in the hood extension to effect the basic advantages sought thereby.

The slightly raised upper portion of the hood extension is also formed with an eyelet 44*c* (best seen in FIGS. 13–15), through which a section of the cable tie 52 immediately adjacent the head thereof is threaded. The outer sidewalls of the hood extension 44 are also provided with cable tie-receiving grooves 44*d* which accurately seat the cable tie circumferentially about the hood extension.

Figure 16:
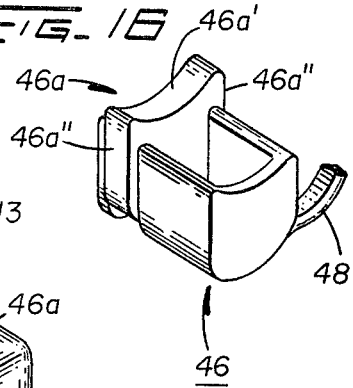
FIG. 16 is an enlarged, perspective view of the pressure pad forming an integral part of the hood of FIG. 11.
Figure 12:
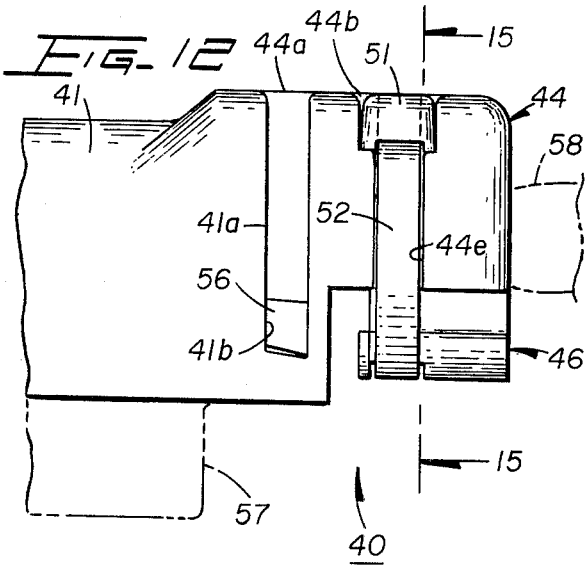
FIG. 12 is an enlarged, fragmentary, side elevational view of a rearward portion of the hood of FIG. 11.

The pressure pad 46, as best seen in FIG. 16, includes a vertically oriented cable engaging rib 46*a* that has an arcuate upper cable engaging edge 46*a'* and two mutually disposed sides that form key-way guided alignment ridges 46*a''*. To accommodate these latter ridges, the mutually disposed sidewalls of the hood extension 44 are formed with respective grooves 44*e* (best seen in the broken away section of FIG. 11). These grooves allow the mating alignment ridges 46*a''* of the pressure pad 46 to be guided therealong to a depth that results in the terminating arcuate edge of the cable engaging rib 46*a* being brought into firm engagement with the underside of a previously inserted jacketed cable. As thus constructed, the pressure pad 46, as in the case of the pressure pad 27, is adapted for telescopic insertion within the U-shaped hood extension, with the proper orientation of the pad being insured at all times, regardless of the size of the cable(s).

The pressure pad rib 46*a*, in a manner similar to the pressure pad rib 27*a*, cooperates with two inwardly extending arcuate ribs 44*e* and 44*f*(best seen in FIG. 14) formed in the inner arcuate surfaces of the main hood body 41 and the hood extension 44, respectively, so as to produce a pronounced strain-relief undulation in the cable. This augments the strain-relief otherwise produced by only the cable tie-initiated clamping force.

Also in correspondence with the hood 20, the sidewalls of the main body 41 of the hood 40 are each formed with a vertically oriented and recessed groove 41*a*. These grooves actually merge into inwardly extending sidewall ribs 44*e'*, best seen in FIG. 14. The latter ribs, in turn, merge into the aforementioned and aligned strain-relief rib 44*e*. Near the base of each groove 41*a* is formed a pair of aligned slots 41*b* (best seen in FIG. 11) that are dimensioned to receive an ear 56 that forms an integral part of the frame of a connector plug 57 shown only in phantom. These slot-confined ears 56 thus prevent any relative movement between the hood and the connector plug, at the common rearward ends thereof, in any direction perpendicular to the longitudinal axes thereof.

With the forward planar hood portion (not shown) preferably being identical to the planar hood portion 24 of the hood 20, the structural snap-ontab details thereof, as previously described, reliably effect the securement of the common forward ends of the hood and connector plug from movement in not only any direction perpendicular to the longitudinal axes thereof, but in the direction of the longitudinal axes thereof.

With respect to both hoods 20 and 40, it should be apparent, of course, that the recessed grooves 23*a* in hood 20, or grooves 41*a* in hood 40, may be eliminated if desired, regardless whether a connector plug with attachment ears or lugs is employed or not. When such a connector plug is employed, however, and the other surfaces of the hood sidewalls have no grooves, the necessary receiving slots for the securement ears may simply be formed as eyelets through the solid, inwardly extending sidewall ribs 23*a'* of the hood 20 (see FIG. 5), or through the corresponding sidewall ribs 44*e'* of the hood 40 (see FIG. 14). Alternatively, of course, the rearward portions of either the hoods 20 or 40, and the connector plug associated therewith, may be adapted so as to be secured by either cooperative snap-on structural details, or by the use of separate fastening means, if desired. The illustrated securement arrangements, however, have been found to be very reliable, simplified and inexpensive.

Figure 13:
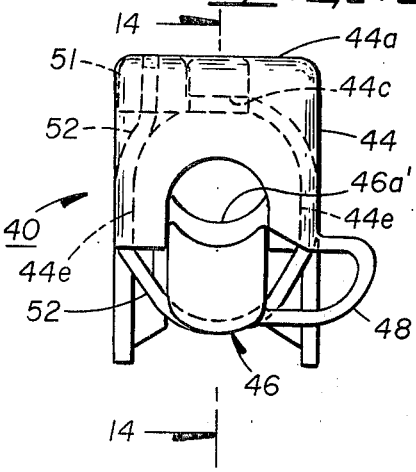
FIG. 13 is an end view of the hood in its intended assembled condition, as viewed in the direction of the arrows 13—13 in FIG. 11.
Figure 14:
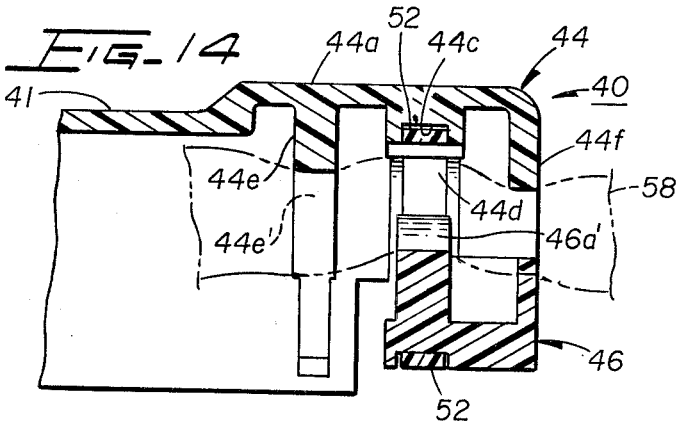
FIG. 14 is an enlarged, fragmentary, sectional view taken along the line 14—14 of FIG. 13, primarily showing the rearward hood extension and the strain-relief function performed by the cooperative cable engaging ribs respectively formed in the hood extension and the interconnected pressure pad.
Figure 15:
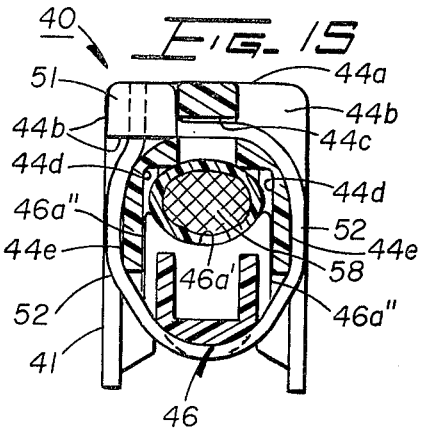
FIG. 15 is a cross-sectional view of the composite hood, connector plug and cable taken along the line 15—15 of FIG. 12.

The particular assembled relationship of the hood 40, pressure pad 44, and the cable tie 52, both with and without a section of cable clamped therewithin, is further illustrated by the end view and cross-sectional view depicted in FIGS. 13 and 15 respectively. No further elaboration on the manner of assembly, or on the assembled hood as depicted in the latter Figures, is believed necessary, however, as the functional nature and relationship of these illustrated structural elements are essentially identical to that of their respective counter-parts described in detail with respect to the hood 20. Moreover, the structural elements of the hood 40 likewise provide the same basic attendant advantages as are realized with their respective counter-parts in the hood 20. The only significant difference of any consequence between the hoods 20 and 40 in actual use is that the hood extension 44 in the second embodiment must necessarily be of greater height than the main body thereof in order to accommodate the head of the cable tie within a preformed recess thereof. In many equipment connector applications, however, this is not of great importance, but when it is, the hood 20, as embodied in FIGS. 1–10, would then generally be preferred.

In summary, two protective molded plastic hoods have been disclosed that are particularly adapted for use in securing multi-conductor cables to connector plugs of the type typically having one or more arrays of terminals associated therewith. Each plastic hood, by having a pressure pad integrally connected to a pressure pad-receiving hood extension formed as an integral rearward portion of the main body of the hood, advantageously allows the composite hood not only to be of one-piece construction, but allows the pressure pad to be key-way guided in a telescopic manner into the hood extension. This insures that reliable, diametrically opposed clamping forces, provided by a cable tie, will always be imparted against a section of cable when positioned between the pad and hood extension, regardless of the diameter of the cable (or cables).

In addition, an inwardly extending rib of the pressure pad is employed to cooperate with two mutually disposed ribs formed in the hood, and located on either side of the pressure pad rib, so as to augment the cable strain relief otherwise effected by only the cable tie-initiated clamping force. As also realized in accordance with one preferred hood embodiment, the pressure pad, as distinguished from the hood extension, is adapted to nest the head of the cable tie therewithin, such that the height of the hood extension may be at the same elevation as the main body portion of the hood and, thereby, minimize the height of the composite assembly. Finally, with both of the disclosed hood embodiments being of one-piece molded plastic construction, and being adapted to effect a sliding snap-on type of locked securement with an associated connector plug, no auxiliary fastening members are required. As such, both hood embodiments are of simplified, inexpensive and rugged construction, and are readily assembled with connector plugs and cables either in the factory or in the field, with only a tool for tightening the cable tie about the composite assembly normally being required.

While two different but related types of hoods have been disclosed herein, it is obvious that various modifications may be made to the present illustrative embodiments of the invention, and that a number of alternatives may be provided, without departing from the spirit and scope of the invention.

I claim:

1. A molded plastic protective hood adapted to enclose a substantial portion of a cable connector plug, comprising:

a main hood body having a cable-receiving opening at one end thereof, and formed with an open-sided connector plug receiving cavity;

an integral hood extension adjacent said open end of said main hood body, and formed into a substantially U-shaped configuration, with inner surface portions of the mutually disposed sidewalls thereof including integral guide means;

a cable engaging pressure pad dimensioned and formed with mutually disposed sides that are contoured so as to be telescopically received within said hood extension, and guided by said guide means;

a resilient integral tongue interconnecting said pressure pad and a selected one of said main hood body and hood extension, and wherein said integral hood extension and pressure pad further selectively include a recessed area adapted to receive at least a portion of a cable tie head, said recess reliably confining the latter when the cable tie is positioned about said hood extension and pressure pad and drawn taut to effect the clamping of a previously positioned section of cable therebetween.

2. A molded plastic protective hood in accordance with claim 1 wherein said pressure pad includes an integral strain-relief rib formed with an outer concave cable-engaging edge, wherein said pressure pad is further formed with said recessed area therein which is adapted to receive at least a portion of, and confine the head of a cable tie therewithin, and wherein the upper wall portion of said hood extension is at substantially the same elevation as the upper wall portion of said main hood body.

3. A molded plastic protective hood in accordance with claim 1 wherein said pressure pad includes an integral cable-engaging strain-relief rib formed with an outer, concave cable-engaging edge, and wherein said hood extension is formed with a raised portion on the upper side thereof that includes said recessed area which is adapted to receive at least a portion of, and confine the head of a cable tie therewithin.

4. A molded plastic protective hood in accordance with claim 1 further including integral locking means that allows the snap-on engagement of said hood with an associated connector plug at the common forward ends thereof, and receptacle means formed in the sidewalls of and near the rearward end of said hood body adapted to telescopically receive aligned and outwardly extending securement means of an associated connector plug.

5. A molded plastic protective hood in accordance with claim 4 wherein said pressure pad further includes an integral strain-relief rib formed with an outer concave cable-engaging edge, said rib cooperating with inner contoured wall areas of said main hood body and hood extension to produce a strain-relief type of undulation in a section of cable when confined within said hood.

6. A molded plastic protective hood in accordance with claim 5 wherein said locking means includes both molded rigid and resilient tab elements that cooperate with aligned portions of an associated connector plug frame.

7. A molded plastic protective hood in accordance with claim 6 wherein said pressure pad is further formed with said recessed area therein which is adapted to receive at least a portion of, and confine the head of a cable tie therewithin, and wherein the upper wall portion of said hood extension is at substantially the same elevation as the upper wall portion of said main hood body.

8. A molded plastic protective hood in accordance with claim 6 wherein said hood extension is formed with a raised portion on the upper side thereof that includes said recessed area which is adapted to receive at least a portion of, and confine the head of a cable tie therewithin.

9. A molded plastic protective hood adapted to enclose a substantial portion of a cable connector plug, comprising:

a main hood body having a cable-receiving opening at one end thereof, and formed with an open-sided connector plug receiving cavity;

an integral hood extension adjacent said open end of said main hood body, and formed into a substantially U-shaped configuration, with inner surface portions of the mutually disposed sidewalls thereof including integral guide means, and with at least selective outer surface wall areas of said hood extension being recessed, aligned and adapted to receive and confine a cable tie therewithin;

a pressure pad dimensioned and formed with mutually disposed sides that are contoured so as to be telescopically received within said hood extension, and guided by said guide means, said pressure pad further including cable-engaging strain-relief means;

a resilient, integral tongue interconnecting said pressure pad and hood extension, and wherein said integral hood extension and pressure pad further selectively include a recessed area adapted to receive at least a portion of a cable tie head, said recess reliably confining the latter when a cable tie is positioned about said hood extension and pressure pad drawn taut to effect the clamping of a previously positioned section of cable therebetween.

10. A molded plastic protective hood adapted to enclose a substantial portion of a cable connector plug, comprising:

a main hood body having a cable-receiving opening at one end thereof, and formed with an open-sided connector plug receiving cavity;

an integral hood extension adjacent said open end of said main hood body, and formed into a substantially U-shaped configuration, with inner surface portions of the mutually disposed sidewalls thereof including integral guide means, and with at least selective outer surface wall areas of said hood extension having aligned, recessed grooves formed therein adapted to receive and guide a cable tie therealong; and wherein a raised portion is formed on the upper side of said hood extension, with a recessed area being formed therein that is adapted to receive at least a portion of the cable tie head, and to confine the latter when the cable tie is positioned about said hood extension and pressure pad, and drawn taut to effect the clamping of a previously positioned section of cable therebetween, a pressure pad dimensioned and formed with mutually disposed sides that are contoured so as to be telescopically received in close-fitting relationship within said hood extension, and guided by said guide means, said pressure pad further including cable-engaging strain-relief means, and a resilient, integral tongue interconnecting said pressure pad and hood extension.

11. A molded plastic protective hood adapted to enclose a substantial portion of a cable connector plug, said hood comprising:

a main hood body having a cable-receiving opening at one end thereof, and formed with an open-sided connector plug receiving cavity, said cavity including an inwardly extending, cable-engaging strain-relief rib formed near the rearward end of said cavity;

an integral hood extension adjacent said open end of said main hood body, and formed into a substantially U-shaped configuration, with inner surface portions of the mutually disposed sidewalls thereof including guide means, and an inwardly extending, cable-engaging strain-relief rib that is laterally spaced a predetermined distance from said strain-relief rib formed in said main hood body, and with selective outer surface wall areas of said hood extension having aligned, recessed grooves formed therein to at least partially nest and guide an encircling cable tie therealong;

a pressure pad dimensioned and formed with mutually disposed sides that are contoured so as to be telescopically received within said hood extension, and guided by said guide means, said pressure pad further including cable-engaging strain-relief means located so as to be interposed between and mutually disposed with respect to said strain-relief ribs of said main hood body and said hood extension, with all of said ribs being dimensioned to effect a strain relief type of undulation in a cable passing thereby;

a resilient integral tongue interconnecting said pressure pad and hood extension, and wherein said integral hood extension and pressure pad further selectively include a recessed area adapted to receive in close-fitting relationship at least a portion of a cable tie head, said recess reliably confining the latter when a cable tie is positioned about said hood extension and pressure pad and drawn taut to effect the clamping of a previously positioned section of cable therebetween.

12. A molded plastic protective hood in accordance with claim 11 wherein said pressure pad is formed with said recessed area therein which is adapted to receive at least a portion of, and confine the head of a cable tie therewithin.

13. A molded plastic protective hood in accordance with claim 11 wherein the upper side of said hood extension is formed with a raised portion that includes said recessed area which is adapted to receive at least a portion of, and confine the head of a cable tie therewithin.

14. A molded plastic protective hood adapted to enclose a substantial portion of a cable connector plug, comprising:

a main hood body having a cable-receiving opening at one end thereof, and formed with an open-sided connector plug receiving cavity, said hood body merging into a substantially planar forward nose portion that is formed with molded retainer means adapted to cooperate with aligned forward portions of a connector plug so as to effect a sliding snap-on type of securement therebetween, a rearward portion of said main hood body further including securement means that cooperate with a rearward portion of an associated connector plug so as to effect the securement therebetween in conjunction with the securement of the forward ends thereof;

an integral hood extension adjacent said open end of said main hood body, and formed into a substantially U-shaped configuration, with inner surface portions of the mutually disposed sidewalls thereof including integral guide means, and with at least selective outer surface wall areas of said hood extension having aligned, recessed grooves formed therein so as to at least partially nest and guide a cable tie therealong;

a pressure pad dimensioned and formed with mutually disposed sides that are contoured so as to be telescopically received in close-fitting relationship within said hood extension, and guided by said guide means, said pressure pad further including cable-engaging strain-relief means;

a resilient integral tongue interconnecting said pressure pad and hood extension, and wherein said integral hood extension and pressure pad further selectively include a recessed area adapted to receive in close-fitting relationship at least a portion of a cable tie head, said recess reliably confining the latter when the cable tie is positioned about said hood extension and pressure pad and drawn taut to effect the clamping of a previously positioned section of cable therebetween.

15. A molded plastic hood and multi-conductor cable connector plug assembly, which comprises:

a connector plug adapted to terminate the conductors of a multi-conductor cable;

a main hood body having a cable-receiving opening at one end, and formed with an open sided connector-plug receiving cavity dimensioned to allow the terminating ends of cable conductors to be separated from each other, connected to respectively associated ones of a plurality of terminals of the connector plug, and shielded from the outside;

an integral hood extension that extends rearwardly from the open end of said hood body, and being formed into a substantially U-shaped configuration for telescopically receiving a pressure pad, with inner surface portions of the mutually disposed sidewalls thereof including integral guide means;

a cable-engaging pressure pad formed with mutually disposed sides that are contoured to cooperate with said guide means formed in said hood extension so as to insure the accurate orientation of said pressure pad when telescopically received within said hood extension, said pressure pad further including at least one cable-engaging strain-relief rib that cooperates with inner contoured wall areas of said main hood body and hood extension to produce a strain-relief type of undulation in a section of cable when confined within said hood;

a resilient arcuate strap that interconnects said hood extension and said pressure pad;

integral retainer means formed in a forward end portion of said hood that cooperate with aligned forward portions of the connector plug so as to effect a snap-on type of engagement therebetween;

securement means formed near the rearward end of said hood body that allows positive slide-in engagement of aligned securement elements forming a part of the connector plug such that no separate and loose fastening members are required to effect reliable and permanent securement of the hood to the connector plug, and wherein said integral hood extension and pressure pad further selectively include a recessed area adapted to receive in close-fitting relationship at least a portion of a cable tie head, said recess reliably confining the latter when a cable tie is positioned about said hood extension and pressure pad, and drawn taut to effect the clamping of a previously positioned section of cable therebetween.

16. A molded plastic hood and multi-conductor cable connector plug assembly in accordance with claim 5 wherein said pressure pad is formed with said recessed area therein which is adapted to receive at least a portion of, and confine the head of a cable tie therewithin, wherein the upper wall portion of said hood extension is substantially at the same elevation as the upper wall portion of said main hood body, and wherein said inner contoured areas respectively comprise in said main hood body and hood extension an inwardly extending, cable-engaging strain-relief rib that cooperates with said strain-relief rib formed in said pressure pad to produce said undulation in a section of cable passing thereby.

17. A molded plastic hood and multi-conductor cable connector plug assembly in accordance with claim 15 wherein said hood extension is formed with a raised portion on the upper side thereof that includes said recessed area which is adapted to receive at least a portion of, and confine the head of a cable tie therewithin, and wherein said inner contoured areas respectively comprise in said main hood body and hood extension an inwardly extending, cable-engaging strain-relief rib that cooperates with said strain-relief rib formed in said pressure pad to produce said undulation in a section of cable passing thereby.

18. A cable terminating assembly, said composite assembly comprising:

a multi-conductor cable;

a cable connector plug having a plurality of electrical conductor-receiving terminals formed therein;

a cable tie, and a main hood body having a cable-receiving opening at one end, and formed with an open sided connector-plug receiving cavity dimensioned to allow the terminating ends of the cable conductors to be separated from each other, connected to the respectively associated ones of the connector plug terminals, and shielded from the outside;

an integral hood extension that extends rearwardly from the open end of said hood body, and being formed into a substantially U-shaped configuration for telescopically receiving a pressure pad, with inner surface portions of the sidewalls thereof including integral guide means;

a cable engaging pressure pad formed with mutually disposed sides that are contoured to cooperate with said guide means formed in said extension so as to insure the accurate orientation of said pressure pad when telescopically received within said hood extension, said pressure pad further including at least one cable-engaging strain-relief rib that cooperates with inner contoured wall areas of said main hood body and hood extension to produce a strain-relief type of undulation in a terminating section of the cable confined within said hood;

integral retainer means formed in a forward end portion of said hood that cooperate with aligned forward portions of the connector plug so as to effect a snap-on type of engagement therebetween;

securement means formed near the rearward end of said hood body that allows positive slide-in engagement of aligned securement elements forming a part of the connector plug such that no separate and loose fastening members are required to effect reliable and permanent securement of the hood to the connector plug, and wherein said cable tie is dimensioned to encircle said hood extension and pressure pad after a terminating section of said cable has been positioned therebetween, and wherein said integral hood extension and pressure pad further selectively include a recessed area adapted to receive at least a portion of the cable tie head, and to confine the latter as said cable tie is drawn sufficiently taut so as to reliably clamp said cable between said hood extension and pressure pad, and produce said strain-relief undulation therein.

19. A cable terminating assembly in accordance with claim 18 wherein said pressure pad is formed with said recessed area therein which is adapted to receive at least a portion of, and confine the head of the cable tie therewithin, wherein the upper surface of said hood extension is at substantially the same elevation as the upper wall portion of said main hood body, and wherein said inner contoured wall areas respectively comprise in said main hood body and hood extension an inwardly extending, cable-engaging strain-relief rib that cooperates with said strain-relief rib of said pressure pad to produce said undulation in said clamped cable.

20. A cable terminating assembly in accordance with claim 18 wherein selective outer surfaces of said hood extension are formed with aligned and recessed grooves for at least partially nesting and guiding said cable tie about said assembled hood, connector plug and cable clamped therebetween, and wherein said protective hood further includes an integral resilient strap that interconnects said pressure pad and a selected one of said main hood body and hood extension.

21. A cable terminating assembly in accordance with claim 18 wherein said hood extension is formed with a raised portion on the upper side thereof that includes said recessed area which is adapted to receive at least a portion of, and confine the head of said cable tie therewithin, wherein said inner contoured wall areas respectively comprise in said main hood body and hood extension an inwardly extending, cable-engaging strain-relief rib that cooperates with said strain-relief rib of said pressure pad to produce said undulation in said clamped cable, and wherein selective outer surfaces of said hood extension are formed with aligned and recessed grooves for at least partially nesting and guiding said cable tie about said assembled hood, connector plug and cable clamped therebetween.

* * * * *